US010126090B1

(12) United States Patent
Abernethy

(10) Patent No.: US 10,126,090 B1
(45) Date of Patent: Nov. 13, 2018

(54) MULTI-PATH ARCHERY STRING

(71) Applicant: Hoyt Archery, Inc., Salt Lake City, UT (US)

(72) Inventor: Garrett M. Abernethy, Stansbury Park, UT (US)

(73) Assignee: HOYT ARCHERY, INC., Salt Lake City, UT (US)

( * ) Notice: Subject to any disclaimer, the term of this patent is extended or adjusted under 35 U.S.C. 154(b) by 2 days.

(21) Appl. No.: 15/726,288

(22) Filed: Oct. 5, 2017

(51) Int. Cl.

| | |
|---|---|
| ***F41B 5/00*** | (2006.01) |
| ***F41G 1/467*** | (2006.01) |
| ***F41B 5/14*** | (2006.01) |
| ***F41B 5/10*** | (2006.01) |

(52) U.S. Cl.
CPC ..... *F41B 5/1415* (2013.01); *F41B 5/10* (2013.01); *F41B 5/1411* (2013.01); *F41B 5/1419* (2013.01)

(58) Field of Classification Search
CPC .. F41B 5/00; F41B 5/10; F41B 5/1411; F41B 5/1415; F41B 5/1419
See application file for complete search history.

(56) References Cited

U.S. PATENT DOCUMENTS 2,508,521 A * 5/1950 Lay ..... F41B 5/1411 124/90
2,769,439 A * 11/1956 Layer ..... F41B 5/1411 124/90
3,714,316 A * 1/1973 Angeloff ..... F16G 11/02 124/90
4,011,853 A * 3/1977 Fletcher ..... F41G 1/467 124/87
5,080,084 A * 1/1992 Kendall ..... F41G 1/467 124/87
5,542,186 A * 8/1996 Saunders ..... F41G 1/467 124/87
5,884,617 A * 3/1999 Nelson ..... F41B 5/14 124/90
7,231,915 B2 * 6/2007 McPherson ..... F41B 5/14 124/90
8,453,336 B2 * 6/2013 LoRocco ..... F41G 1/467 124/87
2004/0011345 A1 * 1/2004 Egusquiza ..... F41B 5/1415 124/90

* cited by examiner

*Primary Examiner* — John Ricci
(74) *Attorney, Agent, or Firm* — Dorsey & Whitney LLP

(57) ABSTRACT

An archery string having a length, a first load-bearing path, a second load-bearing path, and at least one binding. The first and second load-bearing paths are laterally spaced apart relative to each other along the length, and the binding holds the first and second load-bearing paths substantially parallel to each other along at least a portion of the length of the string. Portions of the string are not bound to each other but remain parallel and positioned side-by-side. When the length of the string changes due to elongation, stretching, or contraction, the load-bearing paths do not helically twist relative to each other and remain parallel and side-by-side.

27 Claims, 11 Drawing Sheets

MULTI-PATH ARCHERY STRING

TECHNICAL FIELD

The present disclosure generally relates to strings and cables for archery equipment and apparatus, materials, and methods used in their construction and implementation.

BACKGROUND

Bows and crossbows use at least one bowstring or cable to hold tension in their limbs and to shoot arrows and bolts. A traditional bow, recurve bow, or crossbow may have a single bowstring connecting the limbs. Compound bows and crossbows typically have a long bowstring that wraps around the end cams and is used to shoot the arrow. A control buss cable (CBC) connects the bottom cam to the top cam (or vice versa), and a yoked buss cable (YBC) connects the top axle to the bottom cam (or vice versa).

Materials used for strings in bows have evolved over time from sinew and horsehair to steel cabling, to current thermoplastic fibers and other modern materials bundled together. With almost all of these materials, the string is formed when multiple fibers are twisted or otherwise connected to each other. Each strand typically has similar material construction and length. The strands are then twisted together and entwined into bundles or rope-like cords having the length and shape needed for the strings. Some portions may also be "served" or covered with an external cord and/or coating in high-wear areas with serving material that wraps generally circumferentially around the diameter of the entwined strands.

Constructing a bowstring in this manner provides a bowstring with strand material that has high elastic modulus, high tensile break strength, high efficiency (often due to the strand material having low density), and the ability to separate the bundle of fibers into two side-by-side halves in a manner enabling the archer to place a peep sight into the string. The entwined string is also relatively easy to make since the string generally consists of one continuous strand of material (or in some cases two strands having the same material but different color) which is wrapped multiple times in a loop configuration without having to be cut along its length.

When attached to a bow or crossbow, cables and bowstrings are adjusted and tuned to exact specifications in order to maximize efficiency and reduce vibrations, noise, and other potentially negative effects. However, constantly high tensile loads and repeated load cycles tend to elongate the strings over time, thereby decreasing the number of "twists per inch" of the entwined strands along the length of the strings. Environmental conditions (e.g., temperature and humidity) can also elongate or shrink the strings. As a result, accessories such as peep sights or cable splitters that are positioned between bundles of strands of the string tend to rotate relative to the bow over time. The original positioning of these types of accessories is based on a certain length and twist rate of the string, so as those factors change over time, the directional orientation of the accessories change as well, leading to problems such as partially turned peep sights or twisted YBC or CBC ends that connect to cams. The accuracy and efficiency of the bow or crossbow can thereby deteriorate over time. For these and other reasons, archers and other sportsmen are constantly seeking improvements to bowstrings and cables used in archery equipment.

SUMMARY

One aspect of the present disclosure relates to an archery string comprising a length, a first load-bearing path, a second load-bearing path, and a binding. The first and second load-bearing paths may be laterally spaced apart relative to each other along the length, and the binding may hold the first and second load-bearing paths substantially parallel to each other along at least a portion of the length of the string.

In some embodiments, the first load-bearing path may extend through a first bundle of entwined strands, and the second load-bearing path may extend through a second bundle of entwined strands, with the first and second bundles of strands being separate from each other. The first and second bundles of strands may each comprise 9 to 14 strands of thermoplastic polymer fiber or liquid crystal polymer fiber material or may each comprise 3 to 10 strands of carbon fiber or aramid fiber material.

The first and second bundles of strands may each be configured to individually attach to cams of a bow. The first load-bearing path may extend through a first length portion of a bundle of strands, and the second load-bearing path may extend through a second length portion of the bundle of strands. The bundle of strands may comprise 9 to 14 strands of thermoplastic polymer fiber or liquid crystal polymer fiber material or may comprise 3 to 10 strands of carbon fiber or aramid fiber material. In some arrangements, the bundle of strands may comprise a first end, a second end, and a midsection between the first and second ends, with the midsection being configured to attach to a first cam of a bow and with the first and second ends being configured to attach to a second cam of the bow.

The string may further comprise an accessory positioned between the first and second load-bearing paths. The accessory may have a length dimension aligned with a draw plane of the string, wherein the length dimension remains aligned with the draw plane upon elongation/stretching or shrinkage of the string. The accessory may also have a length dimension aligned with a draw plane of the string, wherein the accessory is slidable along an axis substantially parallel to the first and second load-bearing paths without the length dimension rotating out of alignment with the draw plane.

In some configurations, the accessory may comprise a d-loop attached to a first point along the length and to a second point along the length, wherein the first and second points are not covered by the binding. An archery projectile may be configured to nock with a nocking portion of the string, and the first and second load-bearing paths extend through the nocking portion. The binding may be a serving material wrapped around the first and second load-bearing paths, with the serving material preventing shear movement between adjacent points on the first and second load-bearing paths.

Another aspect of the disclosure relates to an archery bow, comprising a riser, a first limb, and a second limb. The first and second limbs may be connected to the riser. A first cam may be connected to the first limb, and a second cam may be connected to the second limb. A string of the bow may have a length extending from the first cam to the second cam, with the string comprising a first load-bearing path, a second load-bearing path, and a binding holding the first and second load-bearing paths together. The first and second load-bearing paths may be arranged parallel to and laterally spaced apart relative to each other along at least a portion of the string.

The bow may further comprise an accessory positioned between the first and second load-bearing paths, wherein the accessory has constant alignment with a draw plane of the string throughout a draw and release cycle of the bow. The string may comprise a midsection that is being looped around a portion of one of the first and second cams. The binding may comprise a serving material wrapped around the first and second load-bearing paths.

In some embodiments, the first load-bearing path may extend through a first plurality of entwined strands, and the second load-bearing path may extend through a second plurality of entwined strands. A cable guard may also be included that may extend from the riser, wherein the first and second load-bearing paths may diverge at a point along the length. The point may be positioned vertically below the string guard when the bow is oriented upright.

In another aspect of the disclosure, a method of manufacturing archery equipment is provided. The method may comprise providing a first length of bowstring material and a second length of bowstring material, orienting the first length of bowstring material substantially parallel to and entwined separate from the second length of bowstring material, and applying a binding material to the first and second lengths of bowstring material, wherein portions of the first and second lengths are bound to each other by the binding material.

The method may further comprise attaching ends of the first and second lengths of bowstring material to cams of a bow. The first and second lengths of bowstring material may be at different positions on a single bundle of strands, and orienting the first and second lengths may comprise bending or folding the single bundle of strands so that the first and second lengths are next to each other. The binding material may comprise a serving material, wherein the method further comprises wrapping the serving material around the portions of the first and second lengths of bowstring material. The binding material may also comprise a coating applied to the portions of the first and second lengths of bowstring material.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
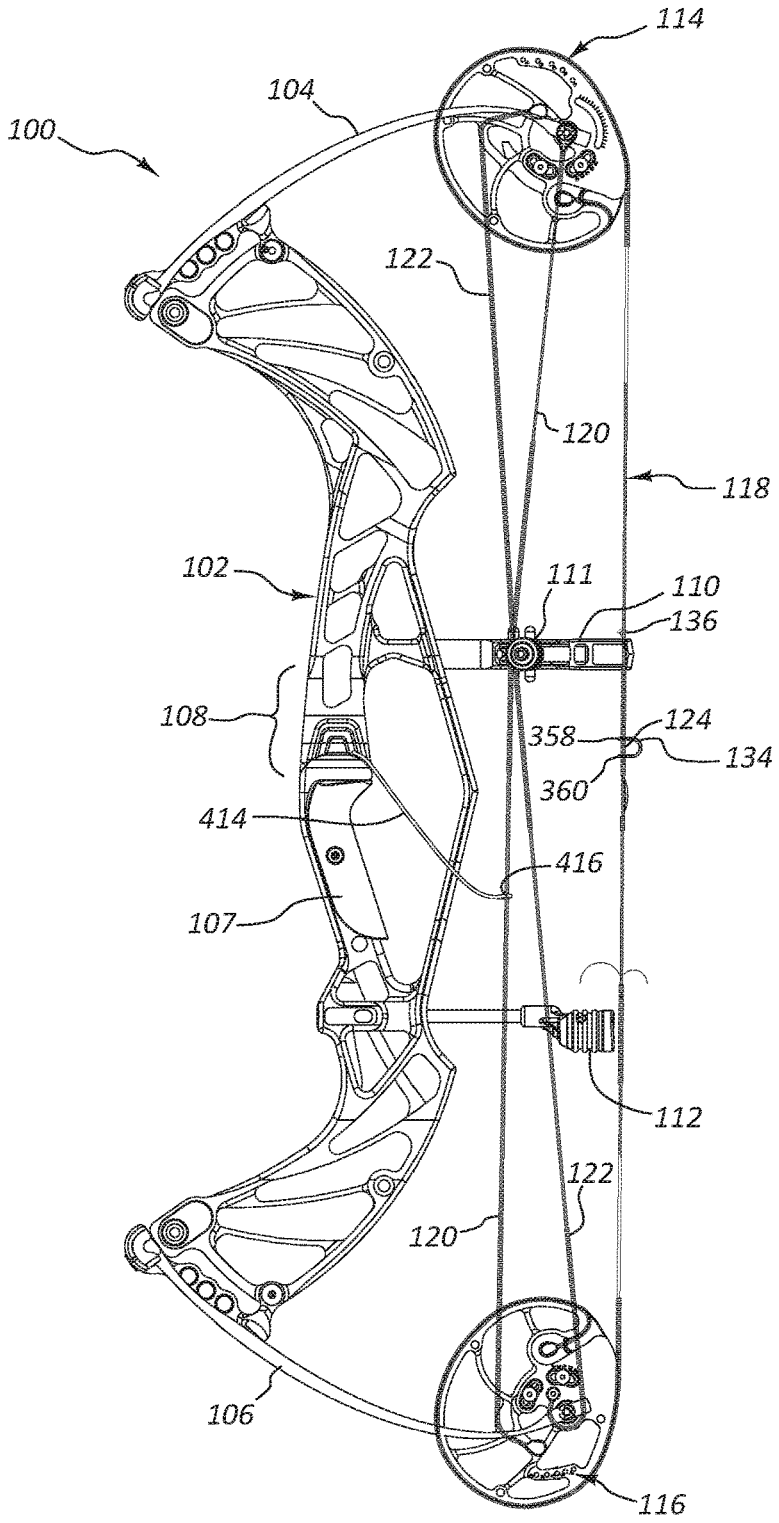
FIG. 1 is a side view of a bow in a brace condition according to an embodiment of the present disclosure, with side walls of grooves in the cam are hidden in order to illustrate string and cable routing paths.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

Many conventional string manufacturing processes use continuous, single-length strands. In these strings, the fibers are entwined into strands, and the strands are entwined and become a single helical rope or cord that is routed from one cam or limb of the bow or crossbow to the opposite cam or limb. A single conventional string may have two or more helical strands that are each individually made up of a plurality of helical fibers, but all of the helical strands and fibers extend generally helically around a single longitudinal axis and form a single generally cylindrical string.

When accessories are attached to conventional strings, strands of the helical bundle may be untwisted and spread apart, the accessories may be inserted between the strands of the bundle, and the accessories may be held in place along the longitudinal axis of the string by radially-directed pressure applied from the strands when the string is under tension. The tension may draw the strands toward the longitudinal axis (e.g., in a direction substantially orthogonal to the longitudinal axis), thereby clamping or pinching the accessory and holding it in place. When the bowstring is drawn, the tension change in the bowstring shortens the bowstring and lengthens the cables (e.g., the YBC and CBC). This concurrent contraction/shrinkage of the bowstring and elongation of the cables changes the twists per unit length (i.e., the twist rate) of each string. This causes the accessories coupled with the strings to rotate within the strings since they are positioned and directionally oriented on the strings based on a predetermined twist rate.

As the strings elongate due to age, wear, and environmental conditions, the twist rate of the strings in the bow may change. Thus, the accessories may be rotated out of proper alignment in the strings. For example, a peep sight installed on the bowstring may have its directional orientation skewed due to decreased twist in an aging bowstring, and it may no longer align with the ring sights of the bow. The archer may therefore have decreased accuracy due to being unable to accurately align the sights of the bow.

Aspects of the present disclosure related to archery strings (bowstrings or cables) that may comprise a plurality of load paths. As used herein, a "string" may refer to a cable used in a compound bow or a bowstring. A string may comprise at least two separate bundles of strands that each comprise about half of the total number of strands of a conventional bowstring or cable. Each of these separate bundles may be independently entwined relative to each other. Thus, each of the separate bundles may comprise individual fibers that are twisted together, and each of those individual fibers may be helically twisted only with other fibers in the same bundle. In some embodiments, individual fibers in a first helically twisted bundle may not be helically twisted together with fibers in a second helically twisted bundle that is radially external to the first helically twisted bundle.

Accordingly, each of the bundles of strands may comprise load-bearing paths that extend through their individual longitudinal axes and that extend substantially parallel to each other along at least a portion of the overall lengths of each of the bundles. The separate bundles may collectively be used as a bowstring or cable in the bow or crossbow. The bundles may be bound together using a binding such as a serving material tightly circumferentially wrapped around the outside of all of the bundles or a coating applied to the bundles that binds them together. The binding may prevent the bundles from sliding or making shear movements relative to each other along the longitudinal axis. Adjacent points along the first and second load-bearing paths through the bundles may be prevented from making shear movement relative to each other due to compressive or clamping forces or adhesion applied by the binding. Thus, in some embodiments, the binding may hold the bundles against each other with sufficient force that friction between the outside surfaces of the bundles is great enough to prevent relative sliding between the bundles along their longitudinal axes. In this way, the string may operate substantially similar to a normal, single-bundle bowstring or cable where the binding is applied, but may have separated, generally parallel bundles where the binding is not applied.

In some embodiments, the strings may have accessories positioned in the space or spaces between the separate bundles where the bundles are exposed from the binding. Such a space may be referred to as a slit or split between the bundles, and the slit or split may have a length dimension that runs parallel to and between the longitudinal axes of at least two bundles in the string. The bundles of strands may contact each other, such that there is no empty space between them where they contact. However, in some embodiments, the natural helical winding of strands in each bundle may cause the diameter of each bundle at any given point to vary, so there may be small through-gaps between the bundles above and below spots on the sides of the bundles where they are in contact with each other. By comparison, a conventional bowstring may have bundles that are helically wound together into a generally cylindrical cord, so a slit between the bundles may run helically around the cord. There may be no through-gap or space between the helically-wound bundles. Accessories in a conventional bowstring may be placed between the helically winding strands of two bundles in a single, generally cylindrical cord. As a result, a conventional string that becomes elongated has its helical winding rate (i.e., twist rate) decrease and may have rotated accessories relative to the longitudinal axis of the string.

However, in embodiments of the present disclosure, elongation of a string as a whole (and/or the collective bundles that make up the string) may only affect the twist rate of the strands in the individual bundles. The slit or split between the bundles is only lengthened or shortened, and does not twist, as the string elongates or contracts. There is no change to the angular orientation of gaps or spaces between the bundles relative to the longitudinal axis. Thus, accessories in a slit or split of embodiments of the present disclosure do not rotate when the string elongates (or contracts). Additionally, because the slit or split between bundles is linear rather than helical, accessories such as a peep sight, d-loop, or rest activation cord may be configured to generally longitudinally slide along the bundles without rotating relative to the bundles. The accessories may therefore be more easily and conveniently adjusted since they can be moved longitudinally on the string without also rotating helically while moving along the string.

In some embodiments, the strings may comprise bundles having strands of composite carbon fiber, aramid, or fiberglass. Other materials may include composites of KEVLAR®, VECTRAN®, DYNEEMA® (i.e., high modulus-polyethylene material), other thermoplastic material, metal or metallic fibers, and related products. In some embodiments, a bundle of strands may comprise at least one of a thermoplastic polymer fiber, a liquid crystal polymer fiber material, a carbon fiber material, and an aramid fiber material. In embodiments comprising a thermoplastic polymer fiber or liquid crystal polymer fiber material, the bundles may comprise about 9 to about 14 strands of the material. In embodiments comprising a carbon fiber material or an aramid fiber material, each bundle may comprise about 3 to 10 strands of the material. These bundles may comprise a smaller than usual number of strands (as compared to a conventional bowstring) since the number of strands in the bowstring effectively doubles when two bundles of strands are oriented parallel and next to each other. Thus, the bundles of strands may each comprise about half the number of overall strands found in a conventional bowstring. By using about 9 to about 14 strands or about 3 to about 10 strands of material, as explained above, the bowstring may have an overall width dimension that fits within cam grooves of a bow (which may have a radius matching the bottom-of-cam groove) without breaking under tension due to abnormal stress of conforming larger string diameter to narrower groove width.

Strings of the present disclosure may be referred to as having a plurality of load-bearing paths. For example, a string may comprise first and second load-bearing paths. Each of the paths may extend generally along laterally spaced apart axes that are substantially parallel to each other. For example, the load-bearing paths may extend through first and second bundles of strands that extend from end to end of the string. The load-bearing paths are laterally spaced apart from each other since each path extends through a separate bundle of strands, and each bundle has a centerline or longitudinal axis spaced apart from the center or longitudinal axis of another bundle. In some embodiments, the load-bearing paths may each be defined as helical paths through the strands of each of the bundles, and the central axes of the helices may be laterally spaced apart from each other.

In some arrangements, the string may comprise a first length when a first tensile load is applied, and the string may comprise a second length when a second tensile load is applied. Under each load, the bundles of the string may be separated from each other by the draw plane of the bow, wherein the "draw plane" is the plane along which the bowstring moves as it is drawn and released. Under each tensile load, a plane extending through the slit or split oriented orthogonal to the plane containing both longitudinal axes of the bundles that does not intersect the outer surface of the bundles may remain aligned with the draw plane.

The binding may comprise a serving material wrapped substantially circumferentially around the external surfaces of the bundles of the string when the bundles are positioned parallel to and in side-by-side contact with each other. The binding may in some arrangements comprise an adhesive material such as a matrix material (e.g., epoxy) that binds the bundles together in the parallel and side-by-side configuration. In yet other embodiments, the binding may comprise a shrink-wrap or other type of wrapping material that shrinks or mechanically compresses and clamps around the bundles of strands, holding them in the parallel and side-by-side configuration. Spans of the length of the string that are not tightly compressed together by an external serving material or adhered to each other by a matrix material or adhesive may remain parallel to and arranged side-by-side each other since the rest of the length of the string bundles are not helically twisted together.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments.

Figure 2:
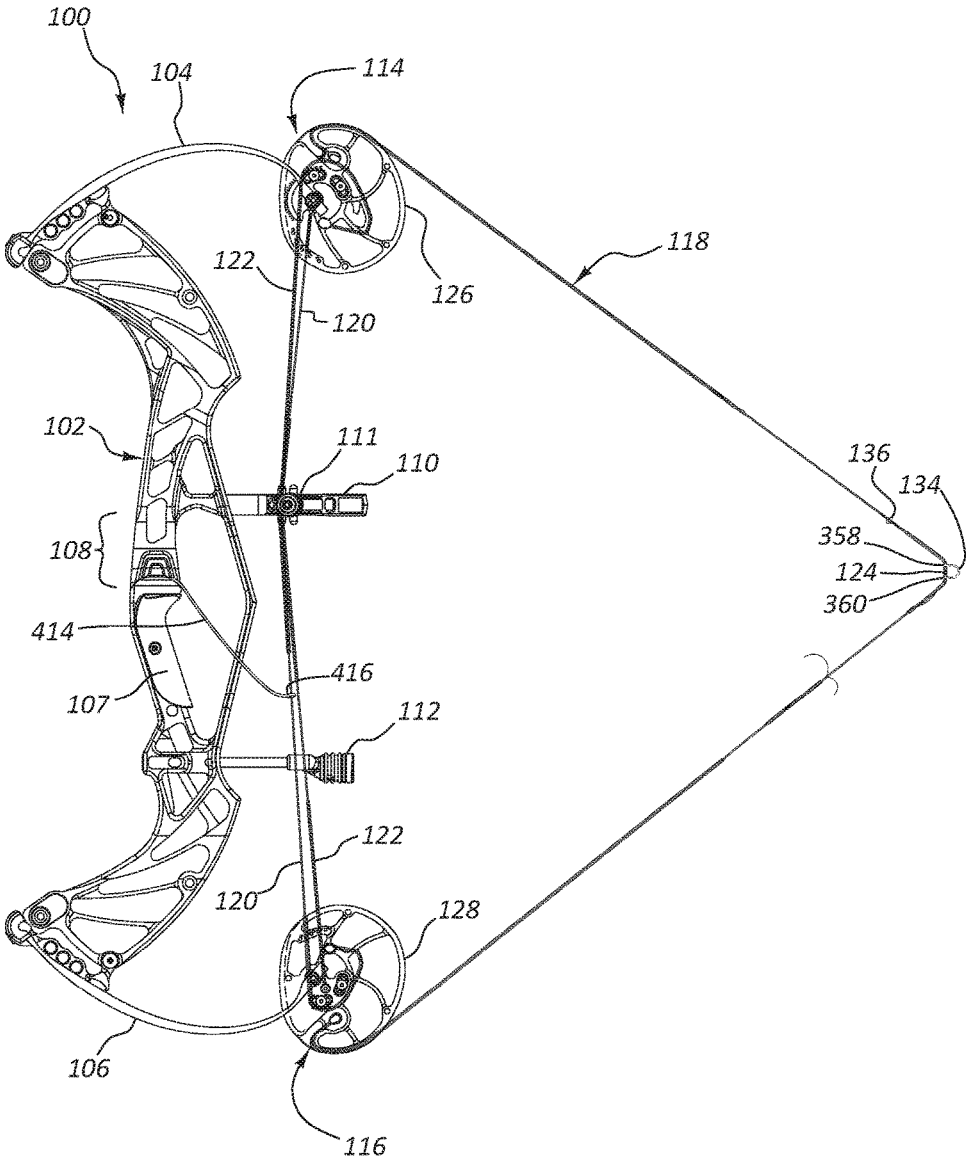
FIG. 2 is a side view of the bow of FIG. 1 in a full-draw condition.

Referring now to the figures in detail, FIGS. 1-2 show an archery bow 100 according to an embodiment of the present disclosure. In FIG. 1, the bow 100 is at a rest position (e.g., a brace position), and in FIG. 2, the bow 100 is at a full-draw position. The bow 100 comprises a riser 102 from which upper limbs 104 and lower limbs 106 extend. The riser 102 may comprise a handle portion 107 (i.e., a grip), a sight window portion 108, a cable guard 110, a string dampener 112, and other parts and accessories commonly known in the art.

The upper limbs 104 may be connected to an upper cam 114, and the lower limbs 106 may be connected to a lower cam 116. A bowstring 118 (i.e., draw string) may extend vertically across the length of the bow 100 between the upper cam 114 and the lower cam 116 when the bow 100 is positioned upright. The terminal ends of the bowstring 118 may be attached to and held wound against the cams 114, 116, at least in the brace position, and the limbs 104, 106 may be flexed to retain tension in the bowstring 118. A yoked buss cable (YBC) 120 and a control buss cable (CBC) 122 may also be attached to and extend between the upper cam 114 and the lower cam 116. Collectively, the YBC 120 and CBC 122 are referred to herein as the cables of the bow 100. The cables 120, 122 may retain tension in the limbs 104, 106 and cams 114, 116 and may be controlled to adjust tension in the bowstring 118, draw length of the bowstring 118, and other tuning features of the bow 100.

The bow 100 shown in the figures is shown for example purposes to illustrate an archery device that may be used in conjunction with the principles and teachings of the present disclosure. Thus, while the bow 100 is a compound bow, it will be understood by those having ordinary skill in the art that the features of the bowstrings, cables, and related methods and apparatuses included in embodiments of the present disclosure may be applied to strings and related methods and apparatuses in traditional bows, recurve bows, crossbows, and other related archery equipment. Similarly, archery equipment applying the teachings of the present disclosure does not need to implement all of the features of the present disclosure. For example, in some embodiments, the bow may not comprise a cable guard 110 or a string dampener 112, so features associated with those accessories may be omitted from the strings of the bow.

When shooting an arrow, the tail end of the arrow may be nocked with the bowstring 118 at a nocking point 124 while the bow 100 is in the rest position shown in FIG. 1. The bowstring 118 may be drawn rearward to the full draw position, as shown in FIG. 2, thereby partially unwinding the bowstring 118 from the outer grooves 126, 128 (see FIG. 2) of the cams 114, 116 and winding the cables 120, 122 around cable winding support portions of the cams 114, 116. The archer may grip the handle portion 107 of the riser 102 and draw back the bowstring 118 using a d-loop 134 or comparable loop attached to the bowstring 118. As the limbs 104, 106 flex inward and the cables 120, 122 wind around the cams 114, 116, the cables 120, 122 may slide along or may be in rolling contact with portions of the cable guard 110, which may comprise at least one roller 111 or other smooth support in contact with the cables 120, 122 where they contact the cable guard 110.

When the bowstring 118 is released, the potential energy stored in the limbs 104, 106 is released, and the bowstring 118 quickly accelerates back toward the brace position as it applies a shooting force to the arrow. As the limbs 104, 106 release their energy, they spread apart, the terminal ends of the bowstring 118 wrap around the cams 114, 116, and the cables 120, 122 unwind from the cams 114, 116. A portion of the bowstring 118 may come into contact with the string dampener 112, which may dampen residual vibrations in the bowstring 118, and the cables 120, 122 may roll or slide against the cable guard 110 as the cams 114, 116 move. Vibrations and reverberations in the bow 100 may dampen out, and bow 100 may return to the brace position shown in FIG. 1. In this process, the cams 114, 116 and at least one roller 111 may rotate relative to the limbs 104, 106 and cable guard 110, respectively, of the bow.

Over time, repeated use of the bow 100 may cause wear on the bowstring 118 and cables 120, 122 where they contact other parts of the bow 100. The bowstring 118 and cables 120, 122 may elongate or contract based on environmental conditions, age, and the amount of tension applied by the limbs 104, 106. Accessories may be attached to the strings of the bow, such as the d-loop 134, a peep sight 136, an arrow rest activation cord 414, string splitter or yoke splitter (see splitter 506 of FIGS. 9-13).

Figure 3:
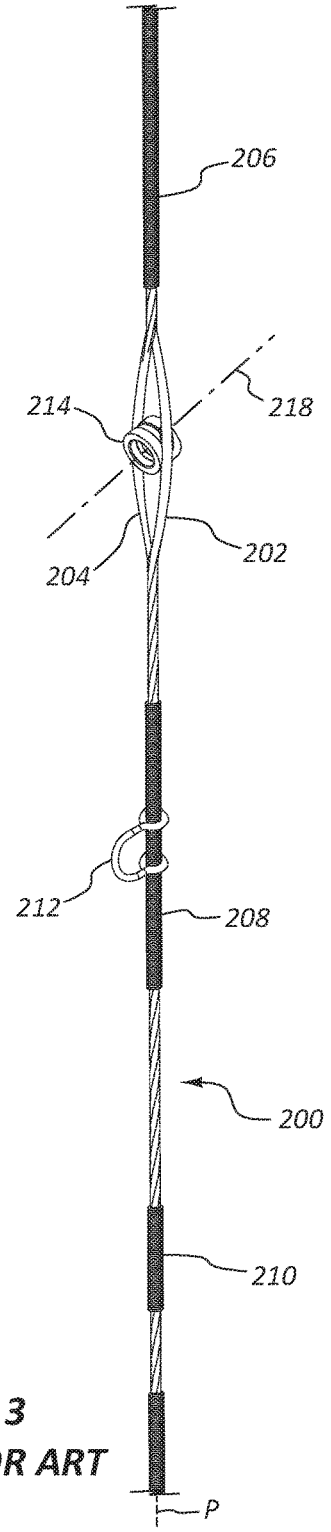
FIG. 3 PRIOR ART
FIG. 3 is a rear view of a portion of a conventional bowstring in a brace condition.
Figure 4:
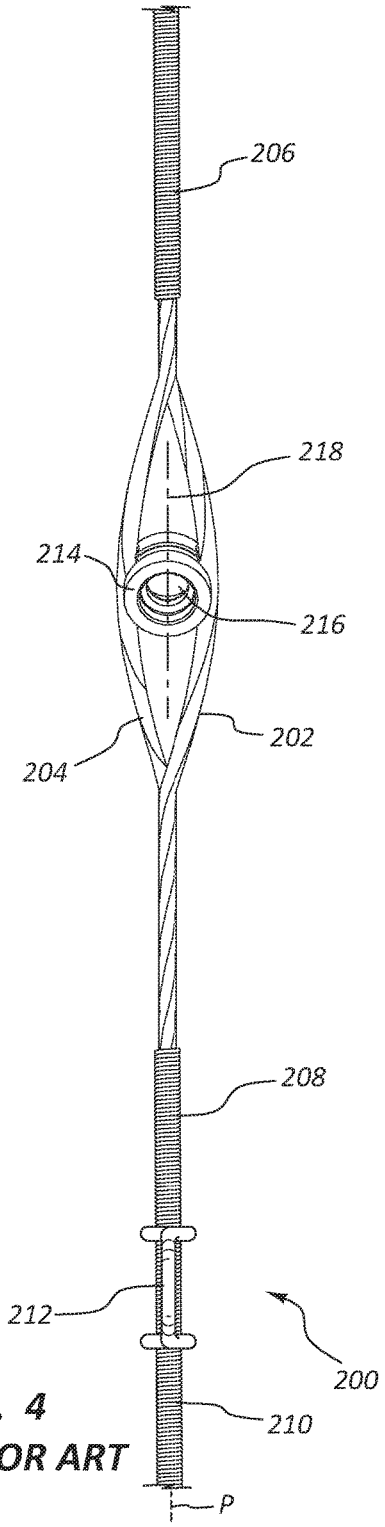
FIG. 4 PRIOR ART
FIG. 4 is a rear view of the bowstring of FIG. 3 in a full-draw condition.

Elongation or contraction of the length of the strings may affect their performance. To illustrate, FIGS. 3 and 4 show rear views of a conventional bowstring 200. The bowstring 200 comprises two bundles of strands 202, 204 that have been entwined in a helical twist along substantially the entire length of the bowstring 200. Serving material 206, 208, 210 is applied at various points along the length of the twisted bundles 202, 204, and accessories including a d-loop 212 and peep sight 214 are positioned on the bowstring 200. The peep sight 214 is positioned laterally between the two bundles 202, 204, and tension in the bowstring 200 causes the bundles 202, 204 to apply inward pressure against the sides of the peep sight 214, thereby keeping the peep sight 214 in place. The d-loop 212 is tied firmly around the serving material 208 near a nocking point on the bowstring 200.

FIG. 4 shows the conventional bowstring 200 at full draw. When the archer aims the bow, he or she may look through the peep sight 214 and align the ring of the peep sight 214 with another ring on the sights of the bow that is positioned on the riser. Accurate alignment of the two circular shapes improves the accuracy of the archer's aim. An axis aligned with the center of the opening 216 through the peep sight 214 is referred to herein as the "sight axis" 218 of the peep sight 214. A bow may be tuned so that the sight axis 218 of the peep sight 214 is in-plane with or parallel to a "draw plane" of the bowstring. The draw plane is referred to herein as the plane in which the bowstring (e.g., 118) moves when it is drawn and released in a normal draw cycle as it shoots a projectile. In FIGS. 3 and 4, the draw plane intersects the surface of the page as a right angle as it extends through the vertical axis P. The sight axis 218 of the peep sight 214 may be configured to be in-plane with or parallel to the draw plane when the string is at full draw to allow a straight sight path through the peep to the sight elements on the riser.

However, the twist rate of the conventional bowstring 200 changes when the tension changes in the bowstring 200 due to tightening/loosening the helical twist of the bundles 202, 204. Accordingly, the angular orientation of the peep sight and its sight axis 218 (relative to the longitudinal axis of the bowstring 200) may change as the bowstring 200 elongates and contracts. At brace condition, the angular orientation of the sight axis 218 of the peep sight 214 is askew (not in-plane with or parallel) relative to the draw plane, as shown in FIG. 3, due to rotation of the point at which the peep sight 214 is located in the bundles 202, 204. The d-loop 134 rotates in a similar manner. Thus, although the accessories (peep sight 214 and d-loop 212) may have the proper amount of angular offset in the brace condition of FIG. 3 when the bow is perfectly tuned, the elongation of the bowstring 200 over time will change the tuning. The angular offset of the accessories in the brace condition and full draw condition will change as the twist rate of the string changes, so the sight axis 218 may be askew relative to the draw plane when at full draw.

Figure 5:
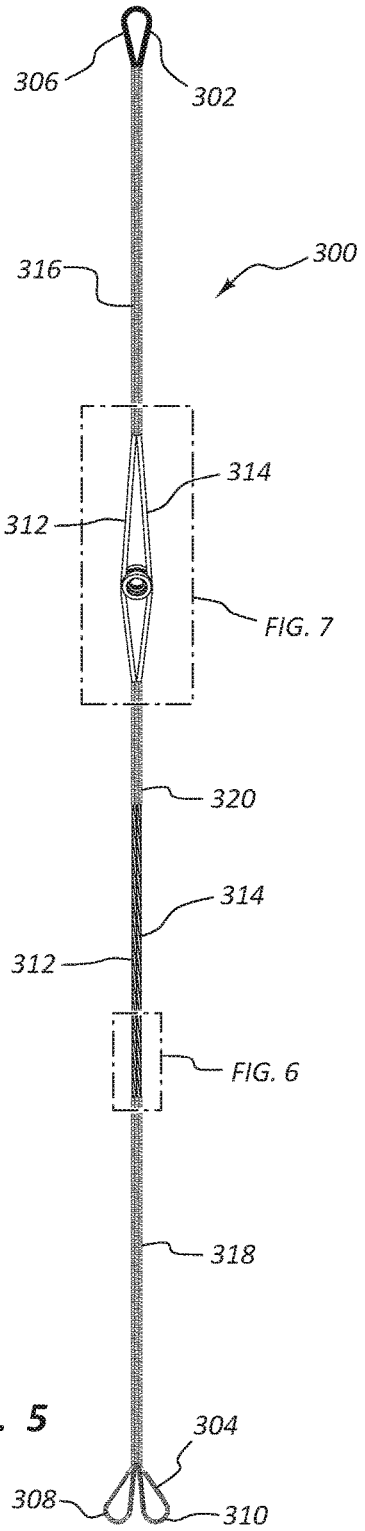
FIG. 5 is a rear view of an embodiment of a string of the present disclosure.
Figure 6:
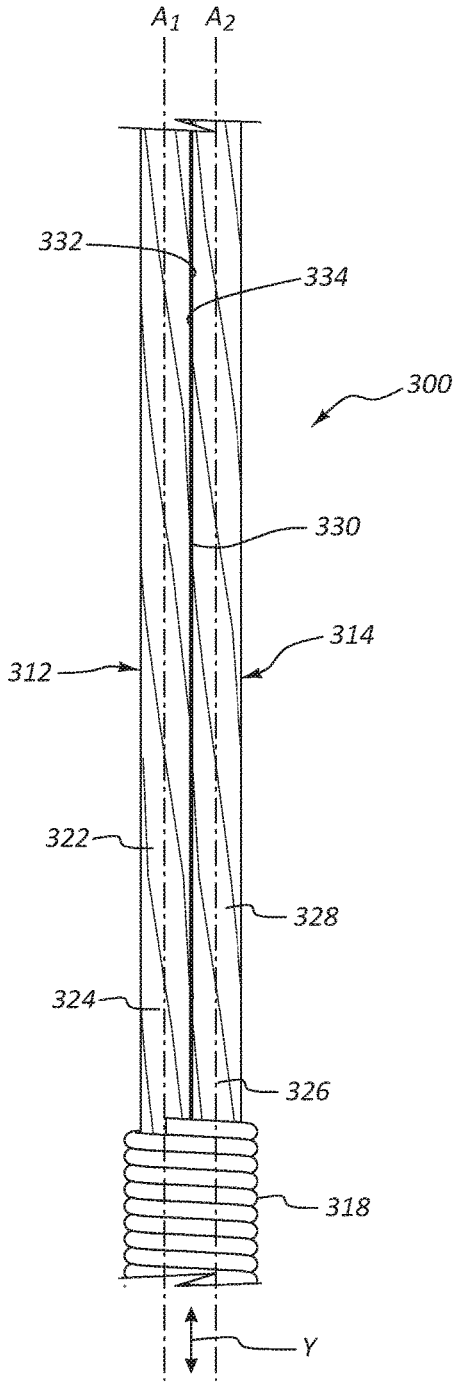
FIG. 6 is a detail view of the string of FIG. 5.
Figure 7:
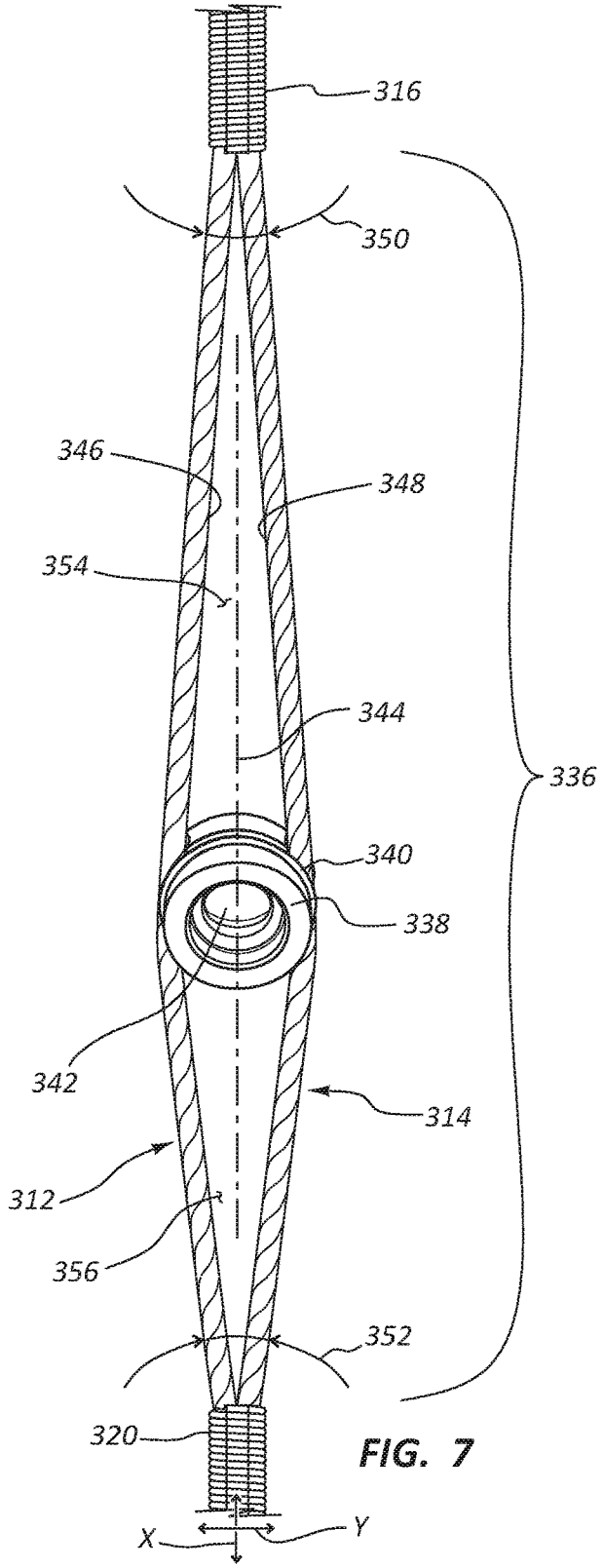
FIG. 7 is a detail view of the string of FIG. 5.

FIGS. 5-7 show a bowstring 300 according to an embodiment of the present disclosure. The bowstring 300 may be used as the bowstring 118 of bow 100 in FIGS. 1 and 2. The bowstring 300 may comprise a first end 302, a second end 304, and a middle portion extending between the first and second ends 302, 304. The bowstring 300 may comprise a first loop 306 at the first end 302 and a second loop 308 at the second end 304. In this embodiment, there is also a third loop 310 at the second end 304.

The bowstring 300 may comprise a first bundle of strands 312 and a second bundle of strands 314 that extend parallel to each other in a side-by-side manner (i.e., they are not coaxial) along most of their separate lengths. See also FIG. 6. The bundles 312, 314 may be bound together along portions of the length of the bowstring 300 by a binding such as a serving material, adhesive, clamp, or shrink wrap. In this embodiment, a first serving 316 covers a portion of the bowstring 300 configured to contact a first cam of a bow (e.g., 114), and a second serving 318 covers a portion of the bowstring 300 configured to contact a second cam of the bow (e.g., 116). A central serving 320 covers a nocking portion of the bowstring 300.

The longitudinal axes $A_1$, $A_2$ of the bundles 312, 314 of the bowstring 300 may be laterally spaced apart from each other, as shown in FIG. 6, which is a detail view of the bowstring 300 as indicated in FIG. 5. The bundles 312, 314 may each comprise a plurality of helically-twisted strands 322, 324, 326, 328. The number of strands in each bundle 312, 314 may be dependent on the type of material used to construct the bowstring 300. In some embodiments, the number of strands in each bundle 312, 314 is about one half of a typical number of strands used in a conventional bowstring. thus, the overall thickness of the bowstring 300 (wherein the overall thickness includes both bundles 312, 314 in combination) may be substantially similar to a conventional bowstring.

Each bundle's 312, 314 strands are helically twisted together without being helically twisted together with any strands of the other, adjacent bundle. Thus, the bowstring 300 may have a linear split 330, slit, or gap running longitudinally along the bowstring 300 between the bundles 312, 314. The bundles 312, 314 may contact each other at various points along the split 330 due to being drawn toward the center (i.e., centrally toward each other) when tension is applied to the bowstring 300. In some arrangements, there may be a plurality of gaps or spaces 332, 334 spaced apart along the split 330 where the helical strands do not contact each other. Those spaced-apart gaps or spaces 332, 334 may be where the diameters of the bundles 312, 314 are narrower than at other points along the split 330. Accessories may be attached to the bowstring 300 in the split 330 and may be retained by radially-inwardly-directed forces applied by the bundles 312, 314 when the bowstring 300 is under tension.

A bowstring 300 having separate parallel bundles 312, 314 may reduce or eliminate angular orientation creep of accessories when the bowstring 300 elongates or contracts over time. The split 330 in the bowstring 300 does not change orientation relative to a draw plane as tension in the bowstring 300 changes since it does not have a twist rate. Hence, the bundles 312, 314 may in some arrangements be positioned on opposite sides of the draw plane in both brace and full-draw conditions of the bowstring 300. A plane intersecting the parallel central axes of the bundles 312, 314 may be arranged substantially orthogonal to the draw plane in the brace and full-draw conditions as well.

Also, because the bundles 312, 314 each have a narrower diameter than an overall conventional bowstring, the fibers that form the strands may be more closely aligned with the longitudinal axes running through each of the bundles 312, 314. In other words, the twist rate of strands in each bundle 312, 314 and their radial distance from the longitudinal axis of each bundle 312, 314 may each be less than strands in a conventional bowstring. As a result, the bundles 312, 314 may more efficiently bear the load of the bowstring 300 due to reduction in internal shear forces applied by the strands against each other, and the bowstring 300 may elongate or contract less in response to changes in tension due to increased bundle axial stiffness.

A binding such as a serving material (e.g., 318) may hold the bundles 312, 314 together along portions of the length of the bowstring 300. The binding may apply a compressive force to the bundles 312, 314 so that under normal operation, the bundles 312, 314 are unable to slide longitudinally relative to each other (i.e., along axis Y in FIG. 6), at least where the binding has been applied. Thus, the compressed bundles within the binding may effectively function as a single, undivided string.

In some configurations, the bowstring 300 comprises two separate bundles 312, 314 that have their terminal ends separate from each other. See FIG. 14. In some embodiments, the bundles 312, 314 are connected to each other at at least one end (e.g., the first end 302 in the embodiment of FIG. 5), such that the end of one bundle 312 is uninterruptedly and unbrokenly connected to the end of the other bundle 314. In other words, the top of one bundle 312 is continuously part of the top of the other bundle 314 as if they were a single bundle forming a loop (i.e., 306) at the first end 302 to form a single bundle. That single bundle may be folded or bent in half so that two portions of its length extend down the final length of the bowstring 300 running alongside each other. Those portions of the length may be referred to as separate bundles 312, 314 even though their ends are connected to each other. Strands from the top end of one of the bundles 312 may be continuous and unbroken with strands from the top end of the other bundle 314. Thus, rather than forming two free ends (as is the case at the second end 304 and at the first and third ends 810, 814 in FIG. 14), the first end 302 may form a single loop (e.g., loop 306) due to the bowstring 300 being a single long bundle that is folded over/doubled over at one end.

The first loop 306 may be referred to as a main section loop or a midsection loop due to being at the middle of the strands that continuously run through the bowstring 300, and the second and third loops 308, 310 may be referred to as terminal end loops or bundle end loops due to being at the terminal ends of the strands that continuously run through the bowstring 300. The first loop 306 may be looped around a portion of a cam of a bow, and the second and third loops 308, 310 may be looped around another cam of the bow.

A first half of the bowstring 300 may be referred to as the first bundle 312, and the second half thereof may be referred to as the second bundle 314. Thus, a "bundle" of strands is a set of entwined strands or a portion of an elongated cord of entwined strands that is helically entwined separate from and running substantially linearly (i.e., not helically) alongside another set of helically entwined strands or another portion of the strands of the cord. As used herein, strands are not "entwined" simply by coming into contact with each other, but instead, when they are helically entwined or twisted together around a common longitudinal axis. The bundles 312, 314 are therefore not "entwined" with each other in this sense where they run alongside each other and they do not share a common longitudinal axis around which they are both helically twisted. Instead, the bowstring 300 may have a central longitudinal axis along the Y-axis in FIG. 6, which extends along the split 330 between the bundles 312, 314.

FIG. 7 shows a detail view of a peep sight portion 336 of the bowstring 300 of FIG. 5. The peep sight portion 336 of the bowstring 300 may extend from the first serving 316 to the middle, central serving 320 and may be configured to be substantially horizontally aligned with sights on a bow (e.g., bow 100). At the peep sight portion 336, the bundles 312, 314 may be laterally spread apart (in a direction parallel to the X-axis in FIG. 7) by the presence of a peep sight 338 inserted between them. Thus, the bundles 312, 314 may form a general diamond shape around the peep sight 338 along the entire lengths of the bundles 312, 314 extending from the first serving 316 to the central serving 320. In conventional bowstrings, the strands are generally twisted tightly around the peep sight, and if they make a diamond shape, it does not extend along the entire length between nearby upper and lower serving locations. Accordingly, embodiments of the present disclosure may provide a taller space in which the peep sight 338 is positioned and may thereby improve the archer's visibility through the peep sight portion 336 of the bowstring 300.

The peep sight 338 may be held between the bundles 312, 314 as longitudinal tension is applied to the bundles 312, 314 (i.e., along the Y-axis) and they simultaneously pinch the sides of the peep sight 338 to clamp it in place while tension remains in the bowstring 300. The peep sight 338 may also be held in place by at least one binding 340 (e.g., serving material, thread, adhesive, or related attachment feature) that helps keep the peep sight 338 from falling out of the bundles 312, 314 if tension in the bundles 312, 314 is released or if lateral pressure is applied to the peep sight 338. The binding 340 may wrap around a combined outer width of the peep sight 338 and bundles 312, 314.

The peep sight 338 may comprise a sight window 342 or ring-like central aperture through which the archer views the target. The sight window 342 may comprise a sight axis 344 configured to align with the other sights on the riser of the bow. As explained above in connection with sight axis 218, the sight axis 344 may be aligned with the draw plane of the bowstring 300 at full draw. The sight axis 344 may be positioned centrally through the sight window 342. When the bowstring 300 elongates and contracts, the peep sight 338 and its sight axis 344 do not change their angular orientation relative to the longitudinal axis of the bowstring 300. Thus, the sight axis 344 remains parallel to the draw plane throughout the entire draw cycle, from brace condition, to full draw, and to release back to the brace condition. The sight axis 344 may be referred to as a length dimension of an accessory of the bow since it extends along the length of the peep sight 338.

As the bowstring 300 ages or is subjected to wear or environmental conditions, its length may change, leading to the peep sight 338 not being perfectly aligned with the sights of the bow. The change of length may cause the peep sight 338 to be too high on the bowstring (i.e., too close to the upper cam 114) or too low on the bowstring (i.e., too close to the lower cam 116). The peep sight may therefore 338 be configured to be adjustable along the length of the bowstring 300 (i.e., along the Y-axis) to tune the sights of the bow. The peep sight 338 may be movable from a first position along the longitudinal axis of the bowstring 300 to a different, second position along the longitudinal axis of the bowstring 300 without the sight axis 344 (or some other length dimension) rotating or changing its angular orientation around the Y-axis as it moves. Thus, the peep sight 338 may be more easily shifted along the length of the bowstring 300 as needed. The movement of the peep sight 338 may be referred to as sliding the peep sight 338 along the longitudinal axis of the bowstring 300 since the peep sight 338 may slide along the inner-facing surfaces 346, 348 of the bundles 312, 314. Other accessories described herein may slide along the longitudinal axis of the bowstring 300 as well.

Adjusting the position of the peep sight 338 on the bowstring 300 may also change the angles 350, 352 formed between the first and second bundles 312, 314. Accordingly, the user may adjust the peep sight 338 to change the shape of the openings 354, 356 through the bundles 312, 314 that are above and below the peep sight 338 if needed.

The d-loop 134 may also be positioned at least partially between the first and second bundles 312, 314. For example, the d-loop 134 may comprise a first end 358 and a second end 360 that are in contact with inner-facing surfaces (e.g., 346, 348) of the bundles 312, 314 on each side of the nocking point 124 of the bowstring 118. See FIG. 1. The first and second ends 358, 360 may extend between the bundles 312, 314 in the split 330 and may have enlarged terminal ends that prevent the first and second ends 358, 360 from being withdrawn back through the bundles 312, 314 when the bowstring 300 is drawn. The d-loop 134 may have a length dimension in-plane with the draw plane of the bowstring 118 and that length dimension may remain in-plane with (and without rotation relative to) the draw plane throughout a draw cycle of the bow 100.

Figure 8:
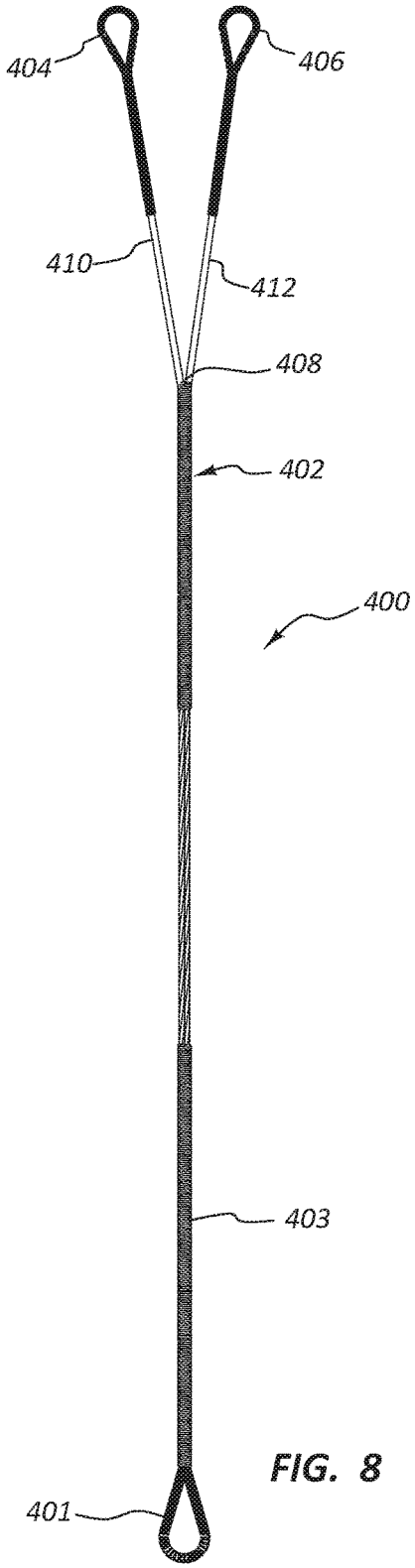
FIG. 8 is a rear view of another embodiment of a string of the present disclosure.

FIG. 8 shows a string 400 of another embodiment of the present disclosure. This string 400 may be used as a cable (e.g., 120, 122) of the bow 100. The string 400 may comprise a general Y-shape for a yoked buss cable (YBC). As with the bowstring 300 of FIGS. 5-7, the string 400 may comprise a continuous bundle of strands that is doubled over and bound together by a first binding 402 and a second binding 403. The Y-shape may be formed as a result of a first separable end 404 and a second separable end 406 being pulled apart where they are not bound together by the first binding 402. The end of the string 400 opposite the first and second separable ends 404, 406 may comprise a loop 401. The first and second separable ends 404, 406 may be configured to connect to a first cam or axle/limb of a bow (e.g., 100), and the loop 401 may be configured to connect to a second cam of the bow.

The vertex 408 (i.e., convergence point of branches) of the Y-shape may be positioned at the end of the first binding 402 between the first and second separable ends 404, 406. The vertex 408 may be positioned at any point along the midsection of the string 400 due to the dual-bundle construction of the string 400. In a conventional cable, the vertex cannot be positioned below a certain point on the length of the cable because the twisting forces applied by helically winding the bundles of strands together causes the branches of the Y-shape to twist together above that certain point even if there is no binding below that point. The separate bundles of embodiments of the present disclosure lack a twisting bias applied to the bundles that urges them to helically twist together.

In some embodiments, the vertex 408 may be positioned between a cable guard of the bow (e.g., cable guard 110) and a lower cam (e.g., 116) of the bow. The branches 410, 412 of the string 400 may therefore each contact separate rollers on the cable guard 110, or one branch (e.g., 410) may contact a roller (e.g., 111), and the other branch (e.g., 412) may not contact a roller or the cable guard at all. This configuration may be beneficial for fine-tuning the angular orientation of the upper cam 114. Positioning the vertex 408 farther than usual from the upper cam 114 enables the user to make finer adjustment of the angle of the cam 114. An adjustment by a unit length of one of the branches 410, 412 may cause less rotation of the upper cam 114 than the same adjustment to a branch of a cable having a vertex 408 closer to the upper cam 114. Additionally, the reduced diameter or thickness of the branches 410, 412 where they contact a roller or the cable guard may reduce stresses and wear on the string 400 at the cable guard since the strands are more closely aligned with the longitudinal axis of their particular branch than would be the case for a thicker string. Also, if one of the branches 410, 412 is not contacting the cable guard at all, the lateral stresses and guard-related wear may be completely avoided.

In some embodiments, the bow 100 may comprise a rest activation cord 414. See FIGS. 1-2. The rest activation cord 414 may extend from the YBC 120 or CBC 122 to an automatic rest activator (not shown) on the riser 102. Upon release of a drawn bowstring 118, the rest activation cord 414 may transfer a force to the automatic rest activator that causes the rest activator to drop an arrow rest (not shown) on the riser out of the way of the path of the projectile being launched. The rest activation cord 414 is an accessory that may be installed with a terminal end 416 positioned between bundles of strands of one of the cables 120, 122, similar to how the peep sight 338 and d-loop 134 may extend through the bundles of strands. As a result, the terminal end 416 of the rest activation cord 414 may be adjustable (e.g., slidable) along the length of the cable to which it is attached. Thus, the user may selectively adjust and control the tension in the rest activation cord 414 and the position of its terminal end 416 on the cable 120/122 without rotating or twisting the length of the rest activation cord 414 around the longitudinal axis of the cable 120/122 where it is attached. In some embodiments, this may enable the user to fine tune the rest activation cord 414 to prevent it from being wrapped around the cable 120/122 as tension changes in the rest activation cord 414 or otherwise getting tangled or out of its proper longitudinal positioning if the cable 120/122 changes length.

Figure 9:
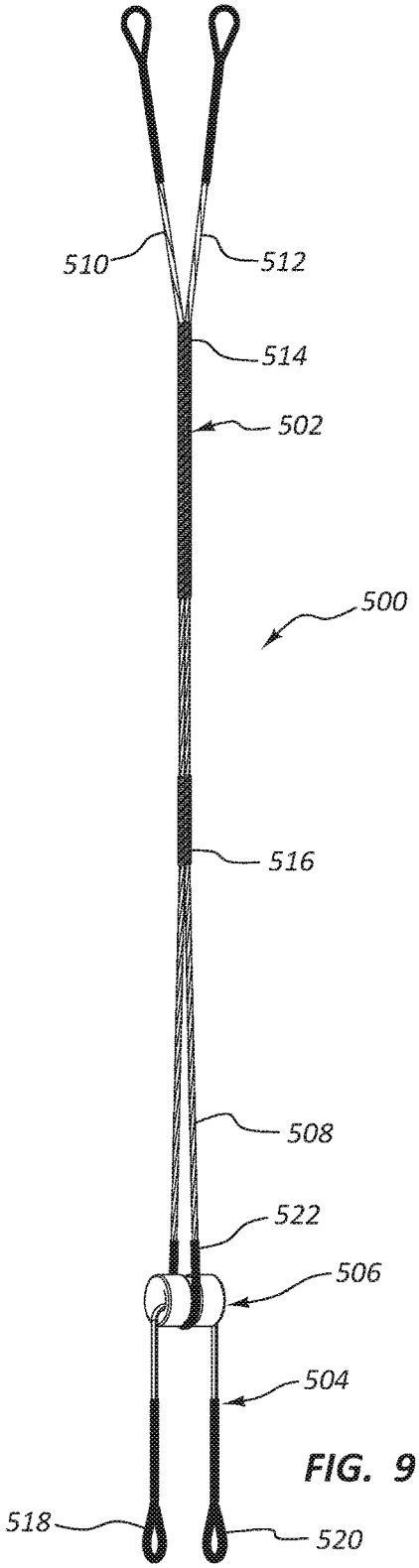
FIG. 9 is a perspective view of another embodiment of a string of the present disclosure.

FIG. 9 is a perspective view of another embodiment of a cable 500 of the present disclosure. This cable 500 may be used as one of the cables 120, 122 of the bow 100 of FIG. 1. The cable 500 may comprise a first string 502, a second string 504, and a cable splitter 506. The first string 502 may have a general Y-shaped configuration, with a main loop 508 through which the cable splitter 506 extends, two branches 510, 512 at the opposite end of the cable 500, a first binding 514, and a second binding 516. As with the bowstring 400 of FIG. 8, the first string 502 may comprise a continuous bundle of strands that is doubled over and bound together by the first and second bindings 514, 516. The Y-shape may be formed as a result of the branches 510, 512 being pulled apart where they are not bound together by the first binding 514. The first and second branches 510, 512 may be configured to connect to a first cam and/or limb of a bow (e.g., cam 114).

The second string 504 of the cable 500 may comprise a first end 518 and a second end 520, with a midsection of the second string 504 extending through the cable splitter 506. The second string 504 may be referred to as a floating yoke. The cable splitter 506 may comprise a hollow shape, with the second string 504 extending through the aperture through the cylindrical shape and the first string 502 wrapping around the radial exterior of the cylindrical shape. A loop binding 522 may be wrapped around the first string 502 along the length of the first string 502 adjacent to the cable splitter 506. The first and second ends 518, 520 may be configured to connect to a second cam of the bow (e.g., cam 116).

When using a compound bow, drawing the bowstring causes the cams to rotate around their axes of rotation. The cams may be prevented from rotating beyond a certain point by cam stops. The cam stops may be configured as small posts or pegs that protrude laterally from the cam (i.e., to the left and right of the cam) when the bow is oriented upright. Thus, when the cam rotates, the cam stops move around the axis of rotation of the cam until coming into contact with a cable attached to the cam (e.g., the YBC). For a cam having two cam stops (each extending from opposite lateral sides of the cam), the cam stops may both come into contact with the cable at full draw because the cable is split into two branches, one on each side of the cam. Ideally, the cam stops contact both sides of the cable simultaneously. Otherwise, energy used to draw the bow is wasted in pulling the bowstring beyond where it needs to be pulled.

Figure 10:
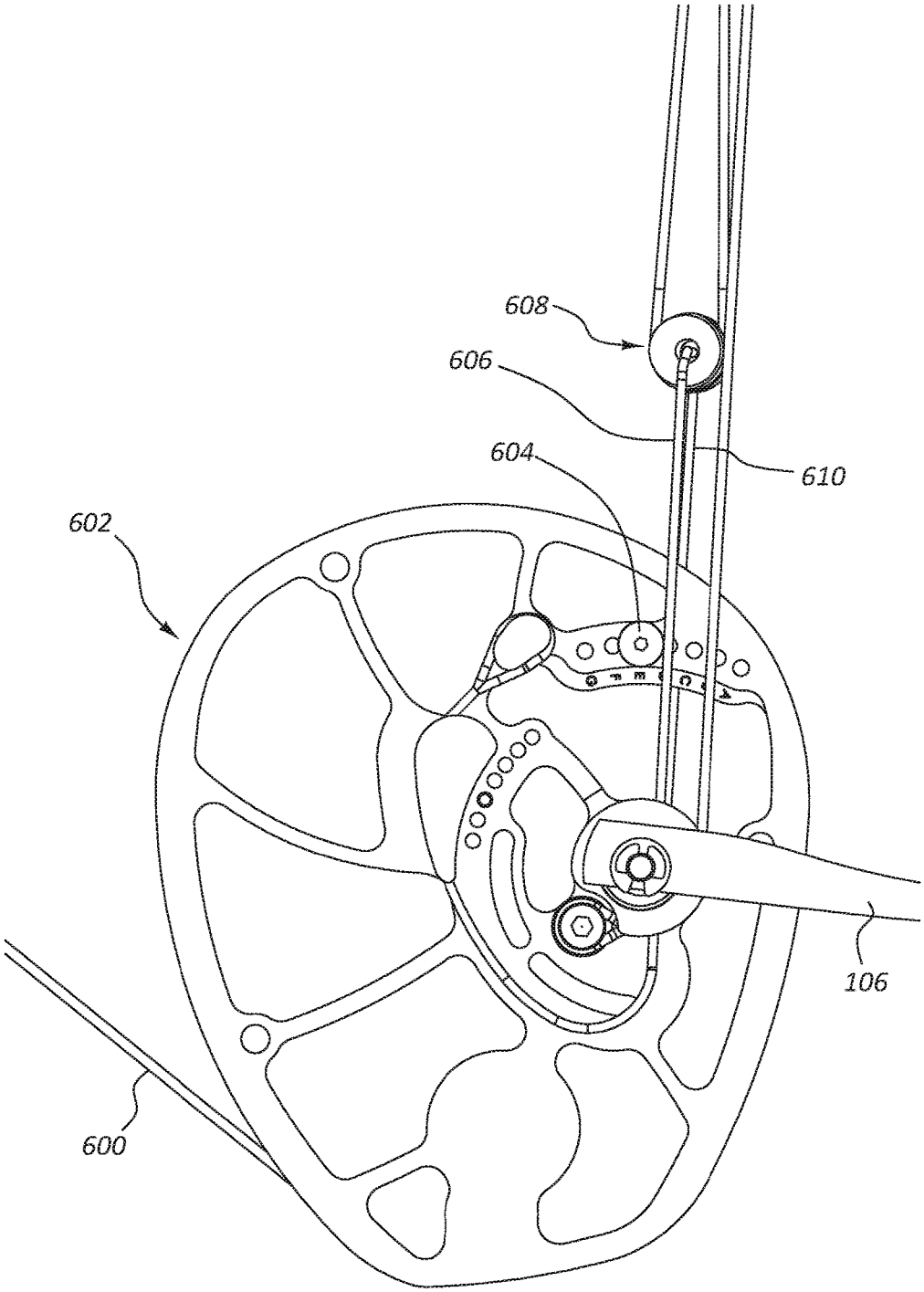
FIG. 10 is a right side view of a cam portion of a bow at full draw.
Figure 11:
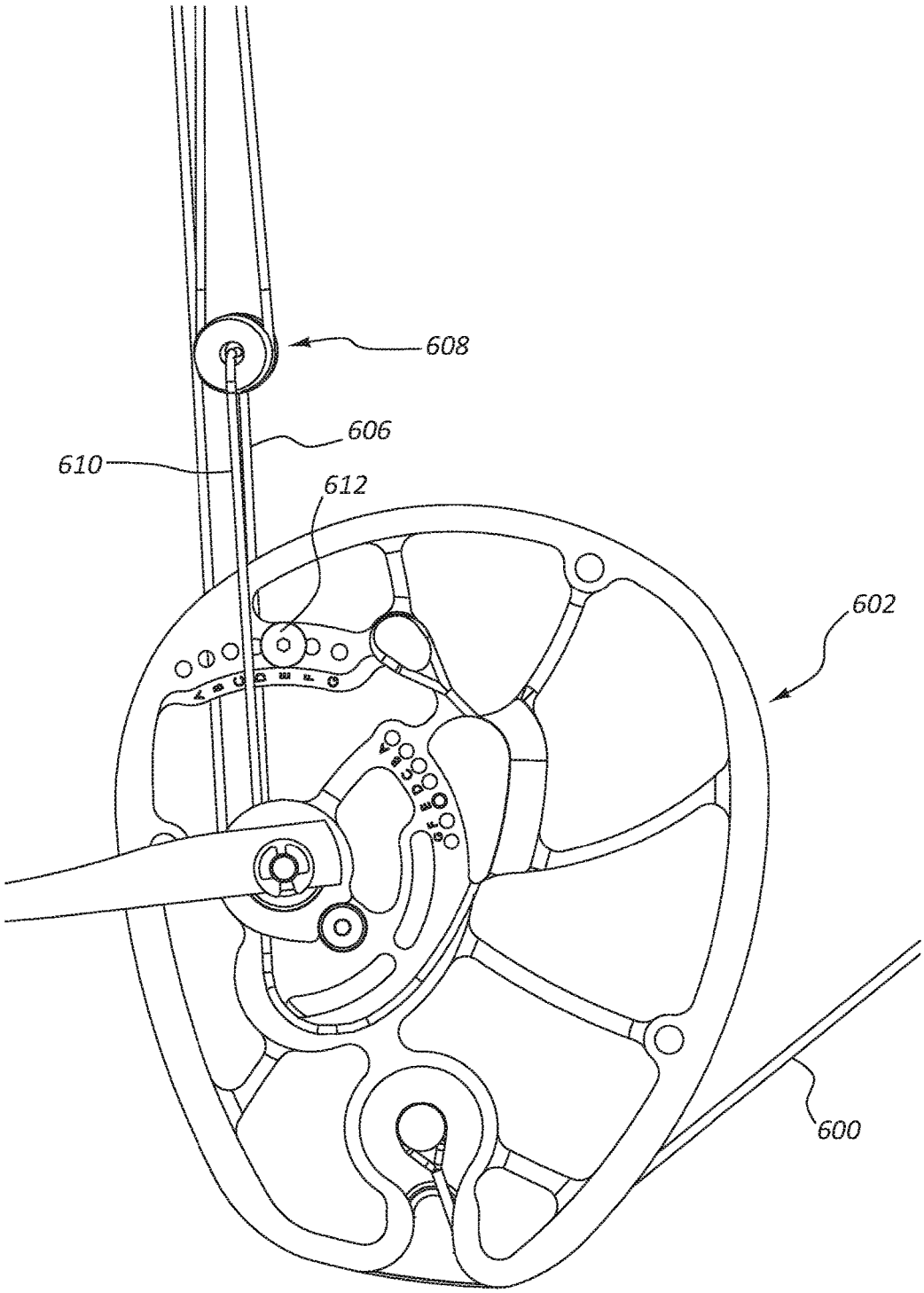
FIG. 11 is a left side view of the cam portion of the bow of FIG. 10.

FIGS. 10-11 illustrate how misaligned cable branches may affect cam stop contact timing. In FIG. 10, the bowstring 600 has been drawn to make the cam 602 rotate until the first cam stop 604 on the cam 602 contacts a right branch 606 of a cable 608. FIG. 11 shows the opposite side of that cam 602 in that position. In FIG. 11, the cam 602 is in the same position relative to the bowstring 600 and cable 608, but a left branch 610 of the cable 608 is twisted relative to the right branch 606 thereof. Accordingly, the second cam stop 612 on the cam 602 is spaced apart rearward from and out of contact with the left branch 610. The user may potentially keep drawing the bowstring 600 from this point until the second cam stop 612 contacts the left branch 610, but the extra effort used to pull the string 600 to that point is not efficiently transferred to a projectile when the bowstring 600 is released. Also, drawing the bowstring 600 that extra amount may apply an excess amount of lateral force against the right branch 606 of the cable 608 since the first cam stop 604 also keeps rotating. That force may cause wear on one side of the cable 608 and on the cam 602 or limbs at the axis of rotation of the cam 602 since the higher forces applied to the right branch 606 may apply a torque to the cam 602 and cable 608.

Figure 12:
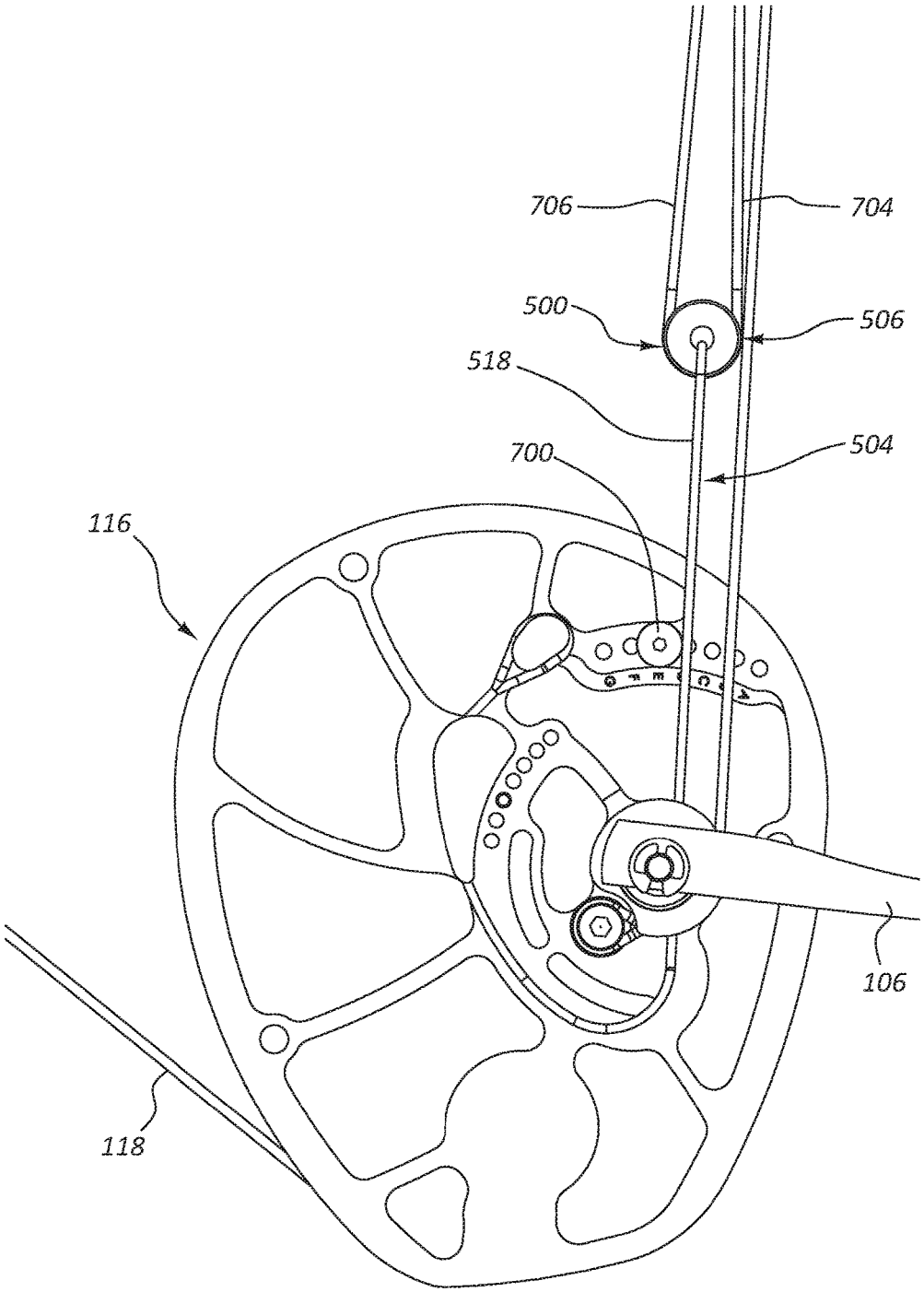
FIG. 12 is a right side view of a cam portion of a bow at full draw.
Figure 13:
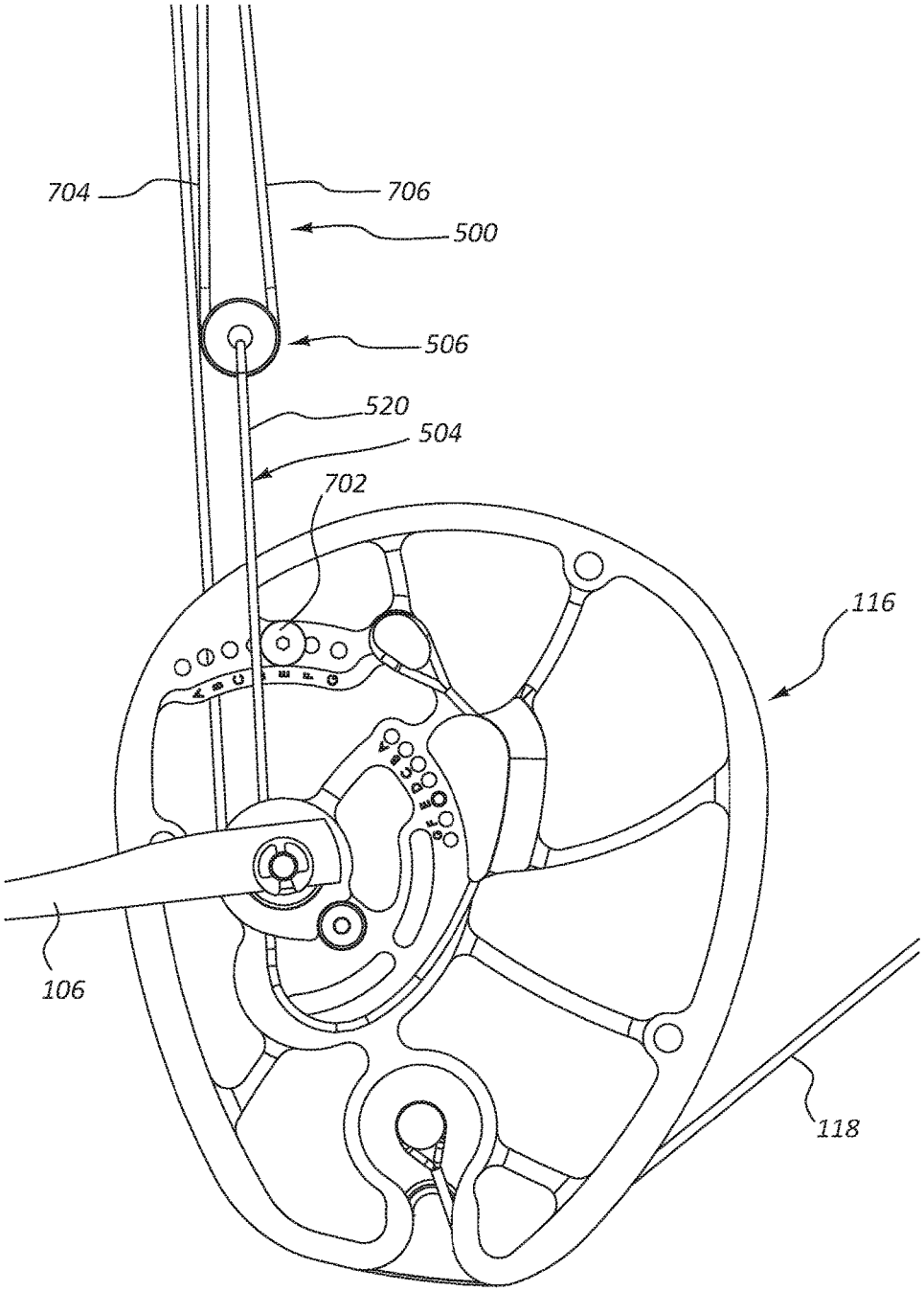
FIG. 13 is a left side view of the cam portion of the bow of FIG. 12.

Embodiments of the present disclosure may reduce the tendency of cables to twist around their longitudinal axes due to elongation or contraction. FIGS. 12-13 show side views of the cable 500 attached to the lower cam 116 with the bowstring 118 at full draw. The cam stops 700, 702 contact the first and second ends 518, 520 of the second string 504 of the cable 500 simultaneously. The main loop 508 of the cable 500 (see FIG. 9) may be constructed with a first side 704 and a second side 706 that are not helically entwined with each other, similar to the bundles 312, 314 described in connection with bowstring 300. Therefore, the first and second sides 704, 706 are not biased to twist around each other. Additionally, even though the main loop 508 and the rest of the cable 500 may comprise a plurality of helically twisted strands to form the first and second sides 704, 706, elongation or contraction of the cable 500 due to tension, age, or environmental conditions may not cause it to helically twist. Accordingly, the cable splitter 506 remains in the position shown in FIGS. 12-13 rather than twisting as a result of a change in length of the first string 502 of the cable 500.

Figure 14:
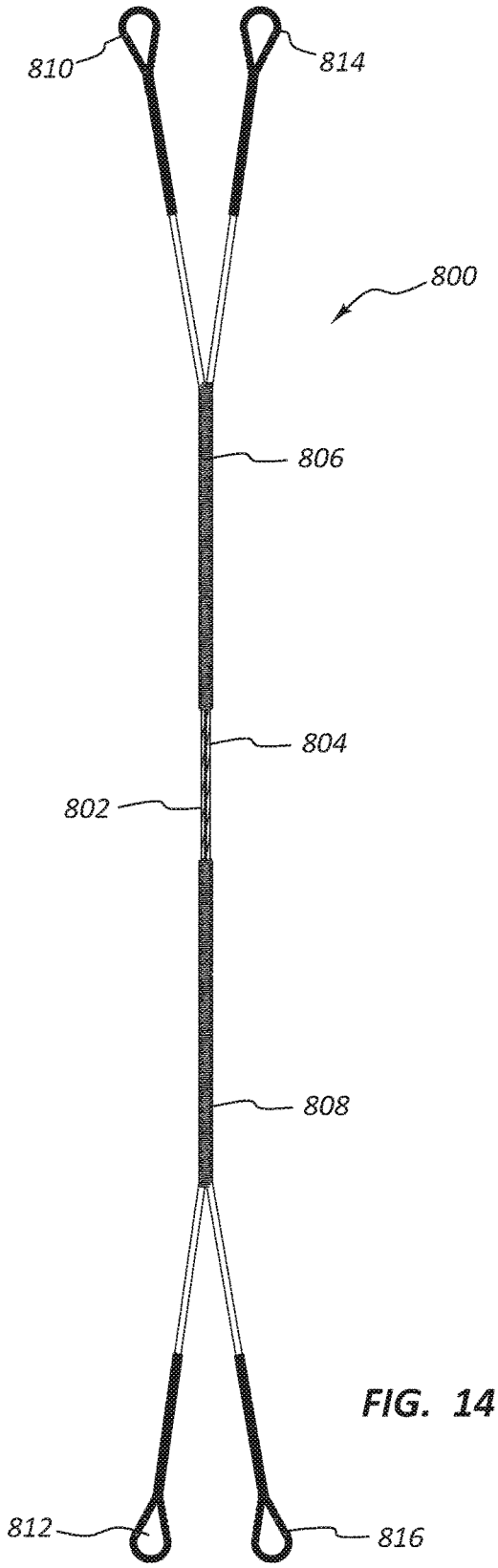
FIG. 14 is a rear view of another embodiment of a string of the present disclosure.

FIG. 14 shows an alternative embodiment of a string 800 of the present disclosure. The string 800 may comprise a first bundle 802 and a second bundle 804, each of which comprise a plurality of strands. Similar to the bundles 312, 314 in bowstring 300, the bundles 802, 804 may extend parallel to each other with their central longitudinal axes laterally spaced apart from each other along a length of the string 800 where the bundles 802, 804 are laterally exposed (i.e., not covered by a binding) between a first binding 806 and a second binding 808.

The first bundle 802 may comprise a first end 810 and a second end 812, and the second bundle 804 may comprise a first end 814 and a second end 816. The first ends 810, 814 may be separable from or movable relative to each other to form a Y-shape above the first binding 806, and the second ends 812, 816 may similarly be separable from each other below the second binding 808, as shown in FIG. 14. In this string 800, the bundles 802, 804 may therefore be formed entirely separate from each other before being bound together, and the ends 810, 812, 814, 816 remain free and loose from each other after they are joined by the bindings rather than the bundles 802, 804 being continuously connected to each other at an end of the string 800, as is the case with loop 306 (see, e.g., FIG. 5). The user may attach the separable ends 810, 812, 814, 816 to two different, spaced apart points on a cam or limb if needed, such as to two points on opposite lateral sides of a cam. As with other strings described herein, the length of the string 800 may elongate or contract without producing helical twist in the alignment of the bundles 802, 804 or ends 810, 812, 814, 816.

Another aspect of the disclosure relates to methods of manufacturing archery equipment. For example, a method may comprise manufacturing a bow, bowstring, cable, or accessories to a bow or string for a bow. In some embodiments, the method may comprise providing a first length of string material and a second length of string material, orienting the first length of string material substantially parallel to the second length of string material. The first and second lengths may be different lengths on a single long strand comprising both first and second lengths (e.g., as in string 300), or the first and second lengths may be lengths of two separately entwined strings or bundles of strands whose ends are not continuous with each other (e.g., as in string 800).

The method may also comprise applying a binding material to the first and second lengths of string material, wherein portions of the first and second lengths are bound to each other by the binding material. The binding material may adhere the first and second lengths of material together or may apply a compressive or clamping force that prevents shear movement between at least portions of the first and second lengths. The first and second lengths of string material may be used as a bowstring or as a cable for a bow. The method may further comprise forming loops at the ends of the first and second lengths of string material (e.g., as in the loops of strings 300 or 800) and attaching accessories to the string between the first and second lengths.

The method may further comprise attaching ends of the first and second lengths of string material to cams of a bow. A single loop of the string material may be attached to one cam, and two loops of the string material may be attached to another cam. In another embodiment, a string splitter is provided, wherein the string splitter extends through a loop of the string material and a second string extends through the string splitter and into attachment with the cam (e.g., as shown in FIGS. 12-13).

In one embodiment, the bow may be configured such that the lengths of the string remain in a single angular orientation as the bow is moved between a first position (e.g., a brace condition) to a second position (e.g., a full-draw condition). In embodiments where the string is attached as a cable connecting the cams, a plurality of cam stops of the cams may contact the second string simultaneously, even if the first and second lengths of string material change from having a first length (e.g., at brace condition) to having a second length (e.g., at full-draw condition) or having a third length (e.g., at full-draw condition with extra elongation due to the string material aging, being affected by environmental conditions, or other similar effects that cause elongation).

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. An archery string, comprising:

a length having a central axis;

a first load-bearing path and a second load-bearing path, the first and second load-bearing paths being laterally spaced apart relative to each other along the length;

a binding holding the first and second load-bearing paths substantially parallel to each other along at least a portion of the length of the string;

wherein a plane through the central axis and the first and second load-bearing paths is configured not to rotate relative to the central axis upon axial elongation or axial contraction of the length.

2. The string of claim 1, wherein the first load-bearing path extends through a first bundle of entwined strands and the second load-bearing path extends through a second bundle of entwined strands, the first and second bundles of strands being separate from each other.

3. The string of claim 2, wherein the first and second bundles of strands each comprise 9 to 14 strands of thermoplastic polymer fiber or liquid crystal polymer fiber material.

4. The string of claim 2, wherein the first and second bundles of strands each comprise 3 to 10 strands of carbon fiber or aramid fiber material.

5. The string of claim 2, wherein the first and second bundles of strands are each configured to individually attach to cams of a bow.

6. The string of claim 1, wherein the first load-bearing path extends through a first length portion of a bundle of strands and the second load-bearing path extends through a second length portion of the bundle of strands.

7. The string of claim 6, wherein the bundle of strands comprises 9 to 14 strands of thermoplastic polymer fiber or liquid crystal polymer fiber material.

8. The string of claim 6, wherein the bundle of strands comprises 3 to 10 strands of carbon fiber or aramid fiber material.

9. The string of claim 6, wherein the bundle of strands comprises a first end, a second end, and a midsection between the first and second ends, the midsection being configured to attach to a first cam of a bow, the first and second ends being configured to attach to a second cam of the bow.

10. The string of claim 1, further comprising an accessory positioned between the first and second load-bearing paths.

11. The string of claim 10, wherein the accessory has a length dimension aligned with a draw plane of the string, wherein the length dimension remains aligned with the draw plane upon elongation or shrinkage of the string.

12. The string of claim 10, wherein the accessory has a length dimension aligned with a draw plane of the string, wherein the accessory is slidable along an axis substantially parallel to the first and second load-bearing paths without the length dimension rotating out of alignment with the draw plane.

13. The string of claim 10, wherein the accessory comprises a d-loop attached to a first point along the length and to a second point along the length, wherein the first and second points are not covered by the binding.

14. The string of claim 1, wherein an archery projectile is configured to nock with a nocking portion of the string, and the first and second load-bearing paths extend through the nocking portion.

15. The string of claim 1, wherein the binding is a serving material wrapped around the first and second load-bearing paths, the serving material preventing shear movement between adjacent points on the first and second load-bearing paths.

16. An archery bow, comprising:

a riser;

a first limb and a second limb, the first and second limbs being connected to the riser;

a first cam connected to the first limb and a second cam connected to the second limb;

a string having a length extending from the first cam to the second cam, the string comprising a first load-bearing path, a second load-bearing path, and a binding holding the first and second load-bearing paths together, the first and second load-bearing paths being arranged parallel to and laterally spaced apart relative to each other along at least a portion of the string, wherein a plane through a central axis of the string and through the first and second load-bearing paths is configured not to rotate relative to the central axis upon axial elongation or axial contraction of the length of the string where the first and second load-bearing paths are laterally spaced apart relative to each other.

17. The bow of claim 16, further comprising an accessory positioned between the first and second load-bearing paths, wherein the accessory has constant alignment with a draw plane of the string throughout a draw and release cycle of the bow.

18. The bow of claim 16, wherein the string comprises a midsection, the midsection being looped around a portion of one of the first and second cams.

19. The bow of claim 16, wherein the binding comprises a serving material wrapped around the first and second load-bearing paths.

20. The bow of claim 16, wherein the first load-bearing path extends through a first plurality of entwined strands and the second load-bearing path extends through a second plurality of entwined strands.

21. The bow of claim 16, further comprising a cable guard extending from the riser, wherein the first and second load-bearing paths diverge at a point along the length, wherein the point is positioned vertically below the cable guard when the bow is oriented upright.

22. A method of manufacturing archery equipment, comprising:

providing a first length of string material and a second length of string material, the first length of string material having a first central axis, the second length of string material having a second central axis offset from the first central axis, the first and second lengths of string material having a collective third central axis;

orienting the first length of string material substantially parallel to and entwined separate from the second length of string material;

applying a binding material to the first and second lengths of string material, wherein portions of the first and second lengths are bound to each other by the binding material;

wherein upon elongation or contraction of the first and second lengths, the first and second central axes do not rotate about the third central axis.

23. The method of claim 22, further comprising attaching ends of the first and second lengths of string material to cams of a bow.

24. The method of claim 22, wherein the first and second lengths of string material are at different positions on a single bundle of strands, and wherein orienting the first and second lengths comprises bending or folding the single bundle of strands so that the first and second lengths are next to each other.

25. The method of claim 22, wherein the binding material comprises a serving material, wherein the method further comprises wrapping the serving material around the portions of the first and second lengths of string material.

26. The method of claim 22, wherein the binding material comprises a coating applied to the portions of the first and second lengths of string material.

27. An archery bow, comprising:

a riser;

a first limb and a second limb, the first and second limbs being connected to the riser;

a first cam connected to the first limb and a second cam connected to the second limb;

a string having a length extending from the first cam to the second cam, the string comprising a first load-bearing path, a second load-bearing path, and a binding holding the first and second load-bearing paths together, the first and second load-bearing paths being arranged parallel to and laterally spaced apart relative to each other along at least a portion of the string;

a cable guard extending from the riser, wherein the first and second load-bearing paths diverge at a point along the length, wherein the point is positioned vertically below the cable guard when the bow is oriented upright.

* * * * *